US007612747B2

(12) United States Patent
Huang et al.

(10) Patent No.: US 7,612,747 B2
(45) Date of Patent: Nov. 3, 2009

(54) ORGANIC LIGHT EMITTING DISPLAY

(75) Inventors: Chien Hsiang Huang, Taiwan (TW); Hong-Ru Guo, Taiwan (TW); Ming-Chun Tseng, Taiwan (TW)

(73) Assignees: Chi Mei Optoelectronics Corporation, Tainan (TW); Chi Mei EL Corporation, Tainan (TW)

( * ) Notice: Subject to any disclaimer, the term of this patent is extended or adjusted under 35 U.S.C. 154(b) by 554 days.

(21) Appl. No.: 11/563,554

(22) Filed: Nov. 27, 2006

(65) Prior Publication Data

US 2007/0146247 A1 Jun. 28, 2007

(30) Foreign Application Priority Data

Nov. 28, 2005 (TW) ..... 94141669 A

(51) Int. Cl.
*G09G 3/30* (2006.01)

(52) U.S. Cl. ..... 345/76; 345/77; 315/169.3

(58) Field of Classification Search ..... 345/76–84, 345/204, 690, 211
See application file for complete search history.

(56) References Cited

U.S. PATENT DOCUMENTS 7,057,588 B2 * 6/2006 Asano et al. ..... 345/76
7,274,345 B2 * 9/2007 Imamura et al. ..... 345/76

* cited by examiner

*Primary Examiner*—Duc Q Dinh
(74) *Attorney, Agent, or Firm*—Fish & Richardson P.C.

(57) ABSTRACT

A display having voltage-driven organic light-emitting pixel circuits. Each pixel circuit includes an organic light-emitting diode, a data writing circuit, a capacitor, three transistors, and a switch. The pixel circuit can compensate the threshold voltage variations of low temperature poly silicon thin film transistors. This increases the stability of the voltage-driven organic light-emitting pixel circuits, improves the uniformity of the luminance of the display, and provides a larger aperture ratio for the pixels.

10 Claims, 9 Drawing Sheets

ORGANIC LIGHT EMITTING DISPLAY

CROSS-REFERENCE TO RELATED APPLICATION

This application claims priority to Taiwan application serial no. 94141669, filed Nov. 28, 2005, the contents of which are incorporated by reference.

BACKGROUND

The present invention generally relates to an organic light-emitting diode display panel, and more particularly, to an organic light-emitting diode display panel that compensates for variations in threshold voltages.

At present, small, thin, short, and light-weighted electronic products are popular and easily accepted by consumers. Also, because of the advantages of being light, thin and easy to place and carry in comparison with the traditional cathode ray tube (CRT) displays, flat panel displays have become widely used nowadays and have a bright prospect.

Please refer to FIG. 1, which illustrates a conventional voltage-driven organic light-emitting pixel 100, the voltage-driven organic light-emitting diode pixel 100 includes transistors m1, m2, m4, m5, m6, and a capacitor Cst having terminals C and D. In addition, a sustaining voltage line Sus_N−3 is electrically coupled to the transistor m5, a scan line Scan_N−3 is electrically coupled to gates of the transistors m2, m4, m5, and m6, and a data line Data_N−3 is electrically coupled to the transistor m6. The signal carried on the scan line Scan_N−3 can determine whether to establish a connection between the terminal C and the sustaining voltage line Sus_N−3 or between the terminal C and the data line Data_N−3. A terminal of the transistor m1 is electrically coupled to a first predetermined voltage VDD. Furthermore, a terminal of the transistor m4 is electrically coupled to a terminal of an organic light-emitting diode 110, and another terminal of the organic light-emitting diode 110 is electrically coupled to a second predetermined voltage VSS. The above-mentioned circuitry structure can compensate for variations in the threshold voltages (Vth) of the driving transistors of the voltage-driven organic light-emitting pixels. To realize such a compensation function, a prerequisite is that the circuit has to ensure that a voltage of the capacitor terminal D is pulled down to a voltage less than VDD−Vth before data is written; otherwise the compensation function of the pixel circuit may fail. However, this circuitry structure does not provide such an assurance action; the pixel circuit therefore has a low stability, and this may lead to luminance non-uniformity (so-called "Mura") of the display panel due to failure of the compensation function.

FIG. 2 illustrates a timing diagram of signals of the pixel circuit of FIG. 1. Referring to FIGS. 1 and 2, the data line Data_N−3 carries a data signal voltage Vdata0 of a data signal Data0. The scan line Scan_N−3 carries a scan voltage signal VScan_N, and the sustaining voltage line Sus_N−3 carries a sustaining voltage Vsus. At image 0, the scan voltage signal VScan_N is at "LOW" logic level, the data signal voltage Vdata0 of the data signal Data0 on the data line Data_N−3 is written into the terminal C and the voltage of the terminal D is pulled up to VDD−Vth. Then, when the scan voltage signal VScan_N is at "HIGH" logic level, the voltage of the terminal C is pulled up by a voltage difference of (Vsus−Vdata0). At this time, the voltage of the terminal D is pulled up to VDD−Vth+(Vsus−Vdata0) due to the voltage stabilization effect of the capacitor Cst. Thereafter, the operation at image 1 is similar to the operation at image 0, but it can be seen from FIG. 2, before the data signal Data 1 is written into the terminal C, the situation of Vd>VDD−Vth is still not improved. As a result, the panel formed by the voltage-driven organic light-emitting diode pixels is not able to compensate the threshold voltage (Vth) variation of the driving transistors of the voltage-driven organic light-emitting diode pixels.

In another aspect, current flat panel displays are becoming higher in resolution. The traditional pixels may not be suitable for use in active organic light-emitting diode display panels with high resolution. This is because the pixels include too many transistors, causing the aperture ratio to be too low.

SUMMARY

The present invention is directed to a voltage-driven organic light-emitting diode pixel which can ensure that a voltage of a capacitor terminal is lower than a predetermined voltage before each time the data is written, thereby ensuring that the threshold voltage variation of driving transistors of the pixels of a display panel can be compensated, thus avoiding luminance non-uniformity of the pixels on the display panel.

The present invention is also directed to an organic light-emitting diode display panel that includes the above-mentioned voltage-driven organic light-emitting diode pixels, allowing the pixels to have relatively larger aperture ratios, thus increasing pixel luminance and reducing cost.

The present invention is further directed to an organic light-emitting diode display panel that can improve the luminance non-uniformity of an image due to a drop in supply voltage (IR drop) of the display panel.

The voltage-driven organic light-emitting diode pixel of the present invention includes an organic light-emitting diode, a data writing circuit, a capacitor, a first transistor, a second transistor, a third transistor and a first switch. The organic light-emitting diode has a first terminal and a second terminal. The data writing circuit is electrically coupled to a data line, a sustaining voltage line and a first scan line. The data writing circuit determines whether to establish an electrical connection between an output terminal thereof and the data line or between the output terminal thereof and the sustaining voltage line according to a first scan signal carried on the first scan line. The capacitor has a first terminal and a second terminal. The first terminal of the capacitor is electrically coupled to the output terminal of the data writing circuit.

In addition, the first transistor has first and second signal terminals and a control terminal. The first signal terminal of the first transistor is electrically coupled to a first predetermined voltage, the second signal terminal of the first transistor is electrically coupled to the first terminal, and the control terminal of the first transistor is electrically coupled to the second terminal of the capacitor. The second transistor has first and second signal terminals and a control terminal. The first signal terminal of the second transistor is electrically coupled to the control terminal of the first transistor, the second signal terminal of the second transistor is electrically coupled to the first terminal, and the control terminal of the second transistor is configured to receive the first scan signal. The third transistor has first and second signal terminals and a control terminal. The first signal terminal and the control terminal of the third transistor are both electrically coupled to a second scan line, and the second signal terminal of the third transistor is electrically coupled to the first signal terminal of the second transistor. The first switch has a switch terminal electrically coupled to the second terminal, and another switch terminal electrically coupled to a second predetermined voltage. The first switch is configured to turn on or turn off according to the first scan signal. The first, second and third transistors are of a same conductive type, and scan sequence of the second scan line is arranged before that of the first scan line.

According to one embodiment of the present invention, the data writing circuit includes a second switch and a third switch. The second switch is electrically coupled between the sustaining voltage line and the output terminal of the data writing circuit, and is configured to turn on or turn off according to the first scan signal. The third switch is electrically coupled between the data line and the output terminal of the data writing circuit, and is configured to turn on or turn off according to the first scan signal, wherein turn-on time durations of the second and third switches do not overlap.

According to one embodiment of the present invention, the first switch of the voltage-driven organic light-emitting diode pixel includes a fourth transistor having first and second signal terminals and a control terminal. The first signal terminal of the fourth transistor is electrically coupled to the second terminal node, the control terminal of the fourth transistor is configured to receive the first scan signal, and the second signal terminal of the fourth transistor is electrically coupled to the second predetermined voltage. The second switch includes a fifth transistor having first and second signal terminals and a control terminal. The first signal terminal of the fifth transistor is electrically coupled to the sustaining voltage line, the control terminal of the fifth transistor is configured to receive the first scan signal, and the second signal terminal of the fifth transistor is electrically coupled to the output terminal of the data writing circuit. The third switch includes a sixth transistor having first and second signal terminals and a control terminal. The first signal terminal of the sixth transistor is electrically coupled to the data line, the second signal terminal of the sixth transistor is electrically coupled to the output terminal of the data writing circuit; and the control terminal of the sixth transistor is configured to receive the first scan signal. The sixth transistor and the first transistor are of a same conductive type, and the conductive types of the fourth and fifth transistors are different from that of the first transistor.

According to one embodiment of the present invention, the data writing circuit includes a second switch and a third switch. The second switch is electrically coupled between the sustaining voltage line and the output terminal of the data writing circuit, and is configured to receive an inverting signal having a phase opposite to the first scan signal to determine turn-on or turn-off thereof. The third switch is electrically coupled between the data line and the output terminal of the data writing circuit, and is configured to turn on or turn off according to the first scan signal, wherein turn-on time durations of the second and third switches do not overlap. Specifically, the first switch includes a fourth transistor, and the fourth transistor has first and second signal terminals and a control terminal. The first signal terminal of the fourth transistor is electrically coupled to the second terminal node, the control terminal of the fourth transistor is configured to receive the inverting signal, and the second signal terminal of the fourth transistor is electrically coupled to the second predetermined voltage. The second switch includes a fifth transistor having first and second signal terminals and a control terminal. The first signal terminal of the fifth transistor is electrically coupled to the sustaining voltage line, the control terminal of the fifth transistor is configured to receive the inverting signal, and the second signal terminal of the fifth transistor is electrically coupled to the output terminal of the data writing circuit. The third switch includes a sixth transistor having first and second signal terminals and a control terminal. The first signal terminal of the sixth transistor is electrically coupled to the data line, the second signal terminal of the sixth transistor is electrically coupled to the output terminal of the data writing circuit; and the control terminal of the sixth transistor is configured to receive the first scan signal.

The organic light-emitting diode display panel of the present invention uses multiple scan lines to control turn-on or turn-off of multiple organic light-emitting diode pixels, wherein the multiple organic light-emitting diode pixels can be implemented with the above-mentioned organic light-emitting diode pixel. When the organic light-emitting diode display panel determines, according to the first scan signal, whether to establish electrical connection between the output terminal and the organic light-emitting diode pixels in the data line or in the sustaining voltage line, at least two of the organic light-emitting diode pixels have their second terminals electrically coupled to the first terminal of the first switch. Therefore, the first switch can be arranged outside the pixel, thus increasing the aperture ratio of the pixel and reducing manufacturing cost of the active organic light-emitting diode display panel.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated embodiments of the invention.

DETAILED DESCRIPTION

Figure 1:
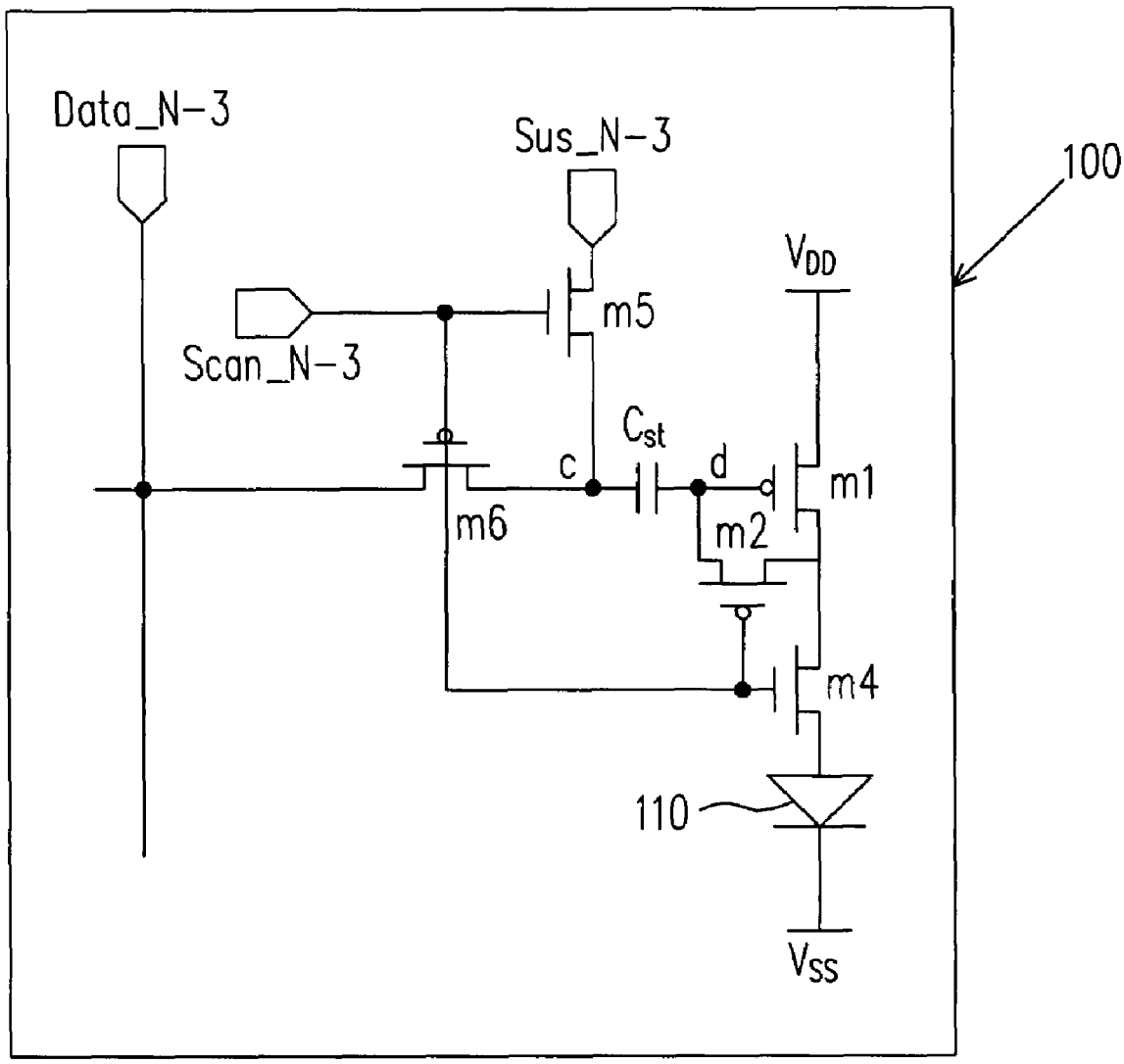
FIG. 1 (PRIOR ART)
FIG. 1 illustrates a circuit diagram of a conventional voltage-driven organic light-emitting diode pixel.
Figure 2:
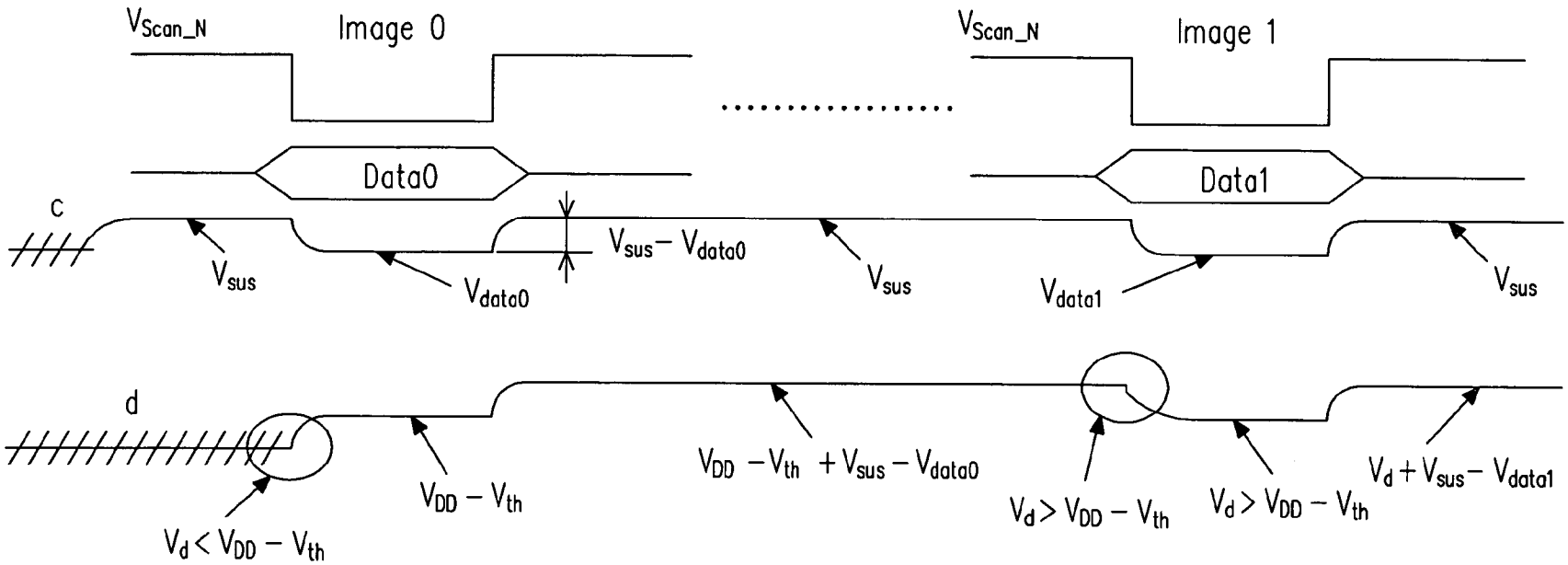
FIG. 2 (PRIOR ART)
FIG. 2 illustrates a timing diagram of the signals of the pixel of FIG. 1.
Figure 3A:
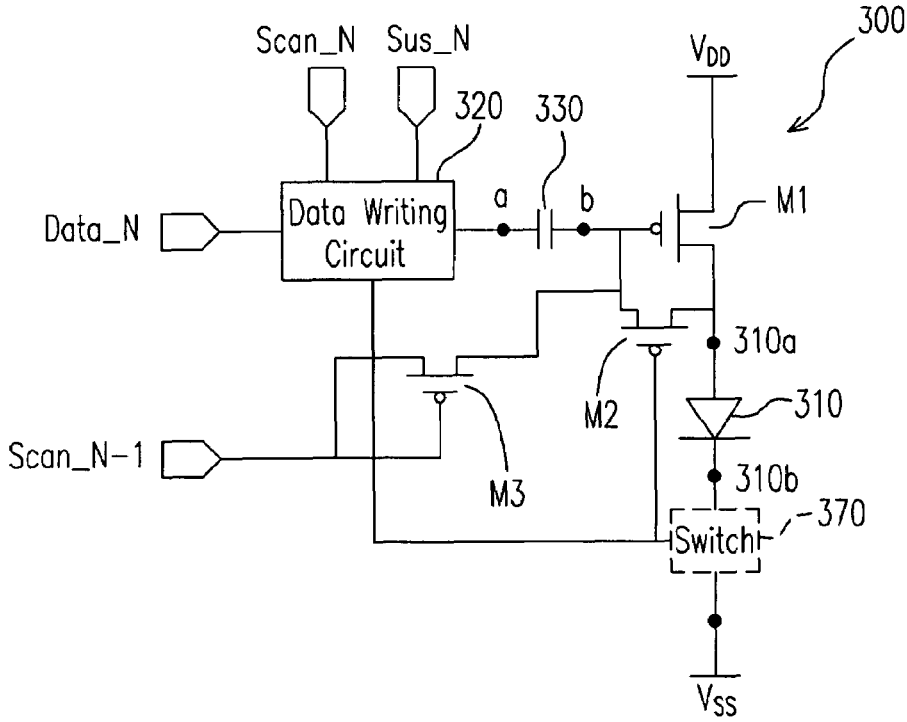
FIG. 3A illustrates a circuit block diagram of a voltage-driven organic light-emitting diode pixel in accordance with an embodiment of the present invention.

Referring to FIG. 3A, this figure illustrates a circuit block diagram of a voltage-driven organic light-emitting diode pixel 300 (referred to as "OLED pixel" hereinafter) in accordance with an embodiment of the present invention. In this embodiment, the OLED pixel 300 includes an organic light-emitting diode 310 (referred to as "OLED" hereinafter), a data writing circuit 320, a capacitor 330, transistors M1, M2, M3, and a switch 370.

The OLED 310 has a first terminal 310*a* and a second terminal 310*b*, and the data writing circuit 320 is electrically coupled to a data line Data_N, a sustaining voltage line Sus_N, and a scan line Scan_N. The data writing circuit 320 determines whether to establish an electrical connection between an output terminal of the data writing circuit 320 and the data line Data_N or between the output terminal of the data writing circuit 320 and the sustaining voltage line Sus_N according to a scan voltage signal VScan_N carried on the scan line Scan_N. In addition, the capacitor 330 has a terminal A and a terminal B, and the terminal A is electrically coupled to the output terminal of the data writing circuit 320.

Figure 3B:
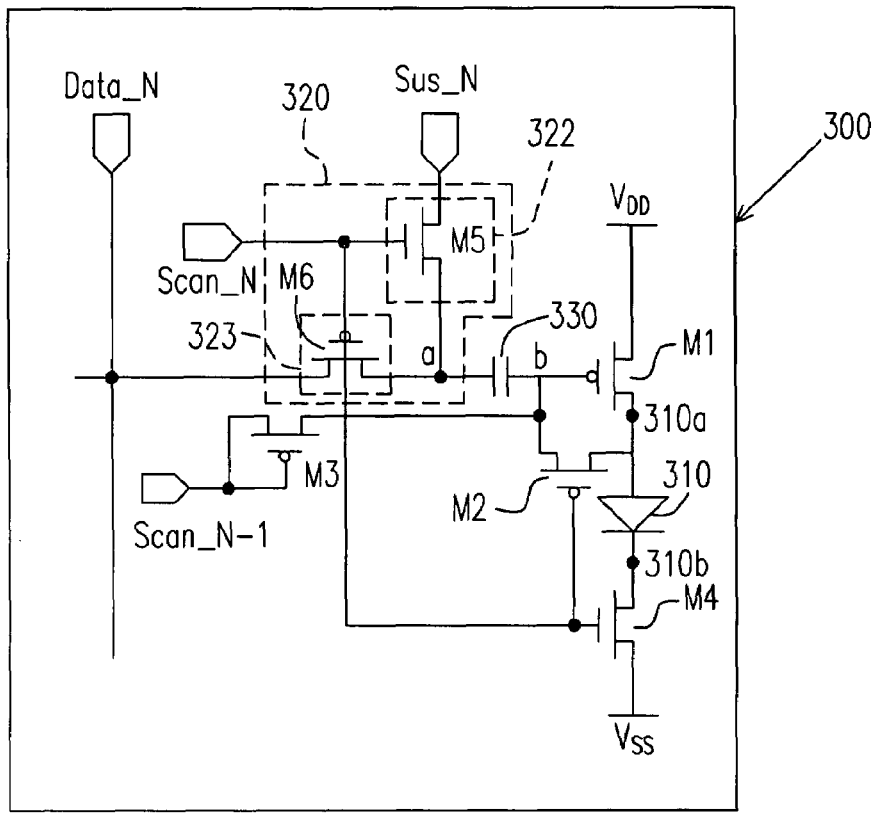
FIG. 3B illustrates a circuit diagram of a voltage-driven organic light-emitting diode pixel in accordance with an embodiment of the present invention.

FIG. 3B illustrates a circuit diagram of the voltage-driven OLED pixel in accordance with an embodiment of the present invention. Referring to FIGS. 3A and 3B, in FIG. 3A, the transistor M1 has a first signal terminal electrically coupled to a first predetermined voltage VDD, a second signal terminal electrically coupled to the first terminal 310*a*, and a control terminal electrically coupled to the terminal B of the capacitor 330. The transistor M2 has a first signal terminal electrically coupled to the control terminal of the transistor M1, a second signal terminal electrically coupled to the first terminal 310*a*, and a control terminal configured to receive the scan voltage signal VScan_N. The transistor M3 has a first signal terminal and a control terminal both electrically coupled to a scan line Scan_N−1, and a second signal terminal electrically coupled to the first signal terminal of the transistor M2. The switch 370 has one terminal electrically coupled to the second terminal 310*b*, and another terminal electrically coupled to a second predetermined voltage VSS. Turn-on or turn-off of the switch 370 is determined according to the scan voltage signal VScan_N. In this embodiment, the transistors M1, M2, and M3 are all P-type thin film transistors, and scanning sequence of the scan line Scan_N−1 is arranged before that of the scan line Scan_N.

In FIG. 3B, the data writing circuit 320 includes a switch 322 and a switch 323. The switch 322 is electrically coupled between the sustaining voltage line Sus_N and the output terminal of the data writing circuit 320, and is configured to turn on or turn off according to the scan voltage signal VScan_N. The switch 323 is electrically coupled between the data line Data_N and the output terminal of the data writing circuit 320, and is configured to turn on or turn off according to the scan voltage signal VScan_N. Turn-on time durations of the switch 322 and switch 323 do not overlap.

In this embodiment, the switch 370 of the voltage-driven OLED pixel includes a transistor M4. The transistor M4 has a first signal terminal electrically coupled to the second terminal 310*b*, a control terminal configured to receive the scan voltage signal VScan_N, and a second signal terminal electrically coupled to the second predetermined voltage VSS. The switch 322 includes a transistor M5. The transistor M5 has a first signal terminal electrically coupled to the sustaining voltage line Sus_N, a control terminal configured to receive the scan voltage signal VScan_N, and a second signal terminal electrically coupled to the output terminal of the data writing circuit 320. The switch 323 includes a transistor M6. The transistor M6 includes a first signal terminal electrically coupled to the data line Data_N, a second signal terminal electrically coupled to the output terminal of the data writing circuit 320, and a control terminal configured to receive the scan voltage signal VScan_N. The transistors M6 and M1 are both P-type thin film transistors and the transistors M4 and M5 are both N-type thin film transistors.

Figure 4:
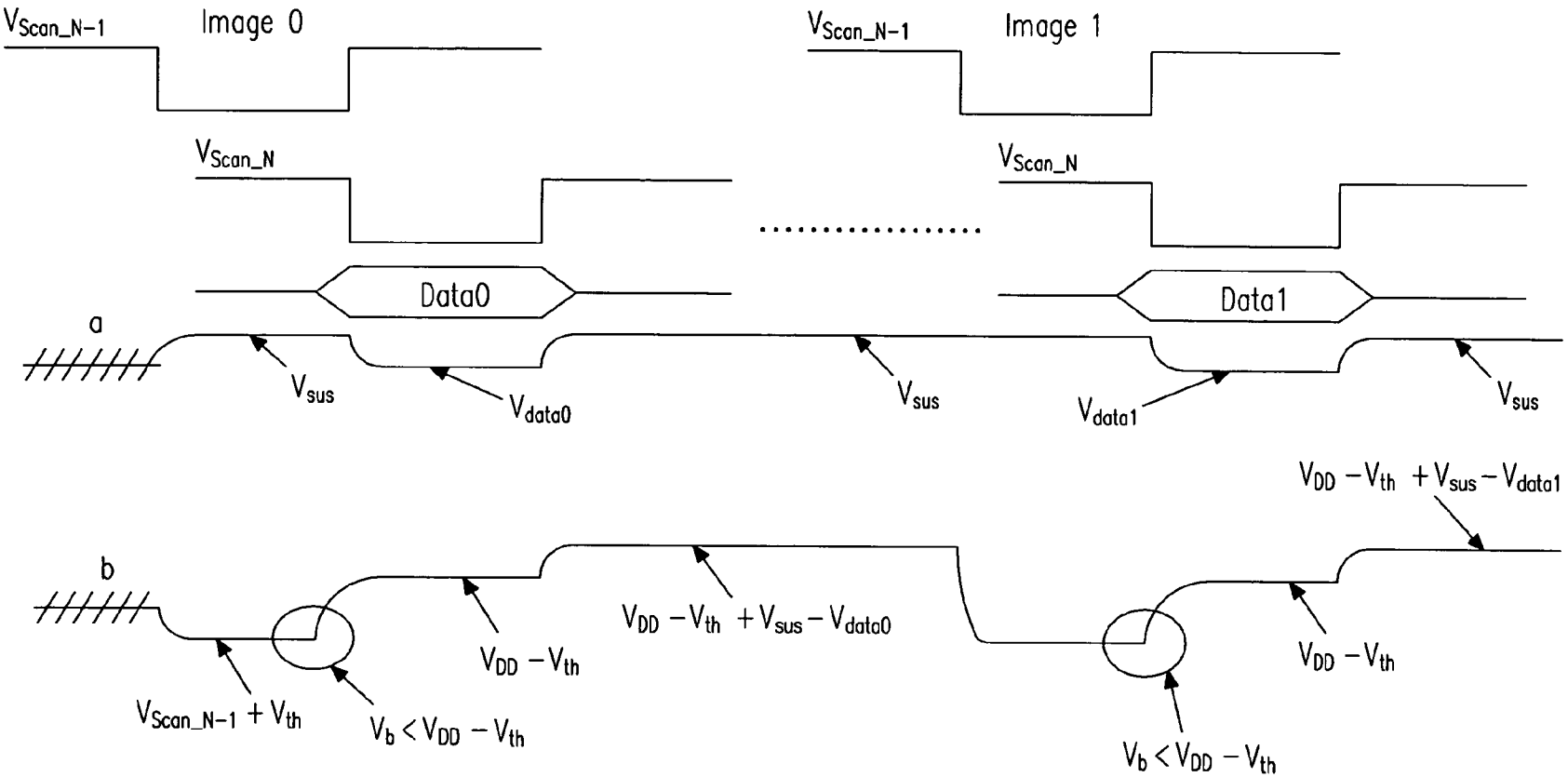
FIG. 4 illustrates a timing diagram of the signals of the pixel of FIG. 3B.

FIG. 4 illustrates a timing diagram of the signals of FIG. 3B. Referring to FIG. 3B and FIG. 4, at image 0, before writing data, that is, when the scan voltage signal VScan_N is at "HIGH" logic level and the scan voltage signal VScan_N−1 is at "LOW" logic level, the transistor M3 is turned on, the transistor M1 is turned on, the transistor M5 is turned on, and the transistor M6 is turned off. As a result, the voltage of the terminal A is equal to the sustaining voltage Vsus carried on the sustaining voltage line Sus_N. In addition, the voltage of the terminal B is equal to the "LOW" logic level of the scan voltage signal VScan_N−1 plus a threshold voltage Vth of the transistor M3, that is, VScan_N−1+Vth. Therefore, it can ensure that the voltage of the terminal B is below VDD−Vth. When the data are written, that is, when the scan voltage signal VScan_N is at "LOW" logic level and the scan voltage signal VScan_N−1 is at "HIGH" logic level, the transistor M3 is turned off, the transistor M1 is turned on, the transistor M5 is turned off, and the transistor M6 is turned on. As a result, the voltage of the terminal A is equal to the data signal voltage Vdata0 of the data signal Data0 at this time, and the voltage of the terminal B is pulled up to VDD−Vth. Thereafter, when the scan voltage signal VScan_N and the scan voltage signal VScan_N−1 are both at "HIGH" logic level, the transistor M3 is turned off, the transistor M1 is turned on, the transistor M5 is turned on, and the transistor M6 is turned off. As a result, the voltage of the terminal A is equal to the sustaining voltage Vsus, which means that the voltage of the terminal A is increased by Vsus−Vdata0. Therefore, the voltage of the terminal B becomes VDD−Vth+(Vsus−Vdata0) due to a voltage stabilizing function of the capacitor 330, causing the OLED 310 to emit light, wherein the amount of the current Id that flows through the OLED 310 can be described as follows:

$$\begin{aligned} I_d &= \frac{1}{2}\beta(V_{gs} - V_{th})^2 \\ &= \frac{1}{2}\beta[V_{DD} - (V_{DD} - V_{th} + V_{sus} - V_{data0}) - V_{th}]^2 \\ &= \frac{1}{2}\beta(V_{data0} - V_{sus})^2 \end{aligned}$$

wherein Vgs represents a voltage difference between gate and source of the transistor M1, and β is a transconductance parameter used to calculate the current Id flowing through the OLED 310. It can be known from the equation (1), the amount of the current Id flowing through the OLED 310 depends on the data signal voltage Vdata0 and the sustaining voltage Vsus, but there are no current paths for the data signal voltage Vdata0 and the sustaining voltage Vsus, the problem of IR drop can thus be avoided.

Afterwards, at image 1, operations of the terminal A and the terminal B are similar to the situation at image 0. It can be known from the above description, the voltage-driven OLED pixel 300 of the present invention can ensure that the voltage of the terminal B is lower than VDD−Vth before each time the data is written, so that when each time the data is written, the voltage of the terminal B can be pulled up to VDD−Vth. Therefore, the pixel circuitry structure of the present invention can compensate for the threshold voltage variations of the driving transistors of the voltage-driven OLED pixels 300 of a display panel that is formed by the OLED pixels 300.

Figure 5:
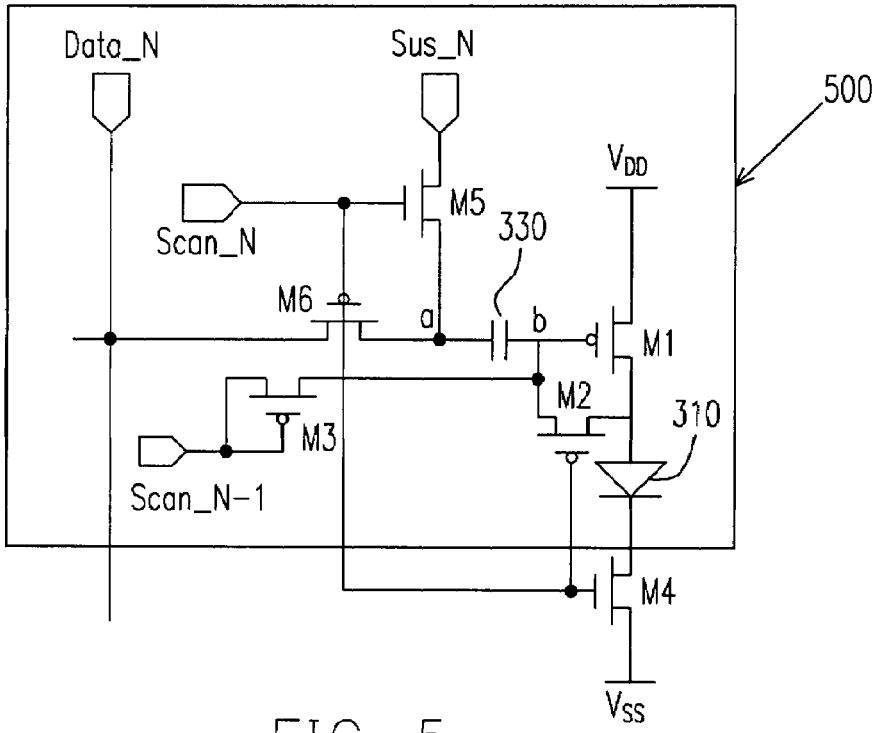
FIG. 5 illustrates a circuit diagram of another voltage-driven organic light-emitting diode pixel in accordance with FIG. 3B.

FIG. 5 illustrates another embodiment of the voltage-driven OLED pixel 500 in accordance with FIG. 3B. Referring to FIG. 5, the voltage-driven OLED pixel 500 includes transistors M1~M6, an OLED 310, and a capacitor 330 having terminals A, B. In addition, the transistor M1 is electrically coupled to a first predetermined voltage VDD, and the transistor M4 is electrically coupled to a second predetermined voltage VSS. A scan line Scan_N is electrically coupled to control terminals of the transistors M2, M4, M5 and M6. A scan voltage signal carried on the scan line Scan_N. determines whether or not to establish an electrical connection between the terminal A and a sustaining voltage line Sus_N or between the terminal A and a data line Data_N. A scan line Scan_N−1 is electrically coupled to a control terminal and a first signal terminal of the transistor M3.

In this embodiment, the transistors M1, M2, M3 and M6 are all P-type thin film transistors; the transistors M4 and M5 are both N-type thin film transistors, and the scan sequence of the scan line Scan_N−1 is arranged immediately before that of the scan line Scan_N.

The voltage-driven OLED pixel 500 described above can also compensate for the threshold voltage variations of the driving transistors of the voltage-driven OLED pixels that form the display panel. In addition, in this embodiment, the transistor M4 and the second predetermined voltage VSS can be arranged outside the voltage-driven OLED pixel 500 in order to increase the aperture ratio of the voltage-driven OLED pixel 500.

Figure 6:
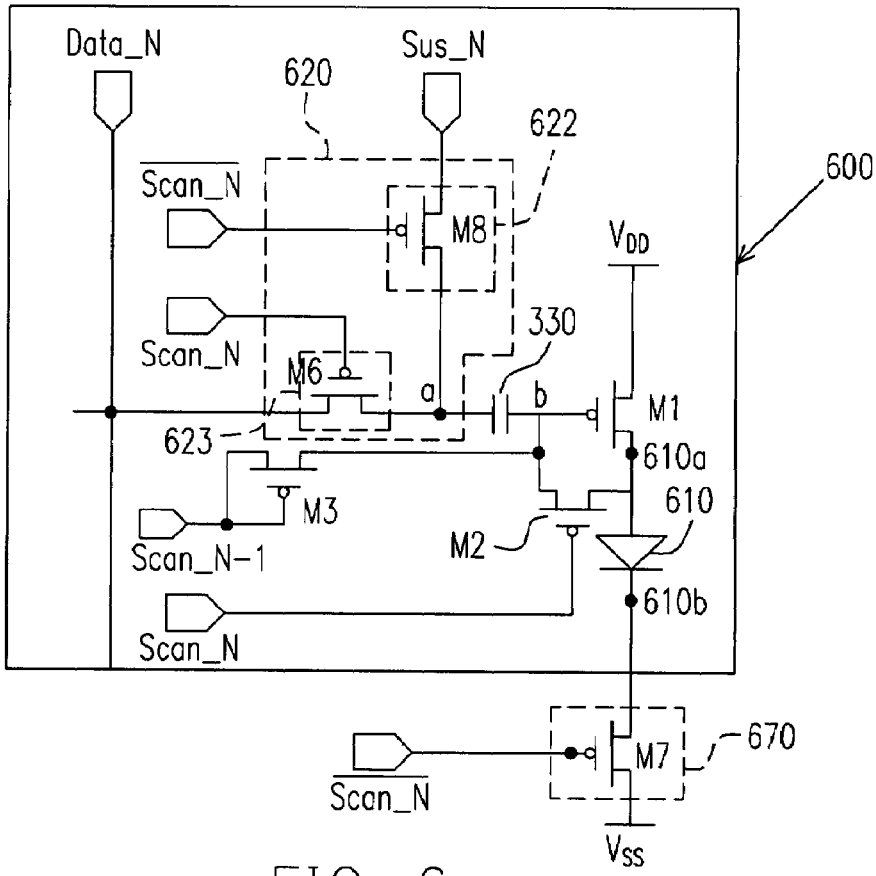
FIG. 6 illustrates a circuit diagram of a further voltage-driven organic light-emitting diode pixel in accordance with FIG. 3B.

FIG. 6 illustrates a further embodiment of the voltage-driven OLED pixel 600 in accordance with FIG. 3B. Referring to FIG. 3B and FIG. 6, the transistors M1~M6 of FIG. 3B are substituted with p-type transistors M1, M2, M3, M6, M7, M8, respectively. This substitution can improve process yield and circuit stability, and reduce manufacturing cost. Further, the voltage-driven OLED pixel 600 includes an OLED 610, a data writing circuit 620, a capacitor 330, the transistors M1, M2, M3 and a switch 670, wherein the OLED 610 has a first terminal 610*a* and a second terminal 610*b*. The data writing circuit 620 is electrically coupled to a data line Data_N, a sustaining voltage line Sus_N and a scan line Scan_N, and the data writing circuit 620 determines whether to establish an electrical connection between an output terminal of the data writing circuit 620 and the data line Data_N or between the output terminal and the sustaining voltage line Sus_N according to a scan voltage signal VScan_N carried on the scan line Scan_N. The capacitor 330 includes terminals A and B, and the terminal A is electrically coupled to the output terminal of the data writing circuit 620.

In FIG. 6, the transistor M1 has a first signal terminal electrically coupled to a first predetermined voltage VDD, a second signal terminal electrically coupled to the first terminal 610*a*, and a control terminal electrically coupled to the terminal B of the capacitor 330. The transistor M2 has a first signal terminal electrically coupled to the control terminal of the transistor M1, a second signal terminal electrically coupled to the first terminal 610*a*, and a control terminal configured to receive the scan voltage signal VScan_N. The transistor M3 has a first signal terminal and a control terminal both electrically coupled to a scan line Scan_N−1, and a second signal terminal electrically coupled to the first signal terminal of the transistor M2. The switch 670 has one terminal electrically coupled to the second terminal 610*b*, and another terminal electrically coupled to a second predetermined voltage VSS. Turn-on or turn-off of the switch 670 is determined according to the scan voltage signal VScan_N. Scan sequence of the scan line Scan_N−1 is arranged immediately before that of the scan line Scan_N.

In FIG. 6, the data writing circuit 620 includes a switch 622 and a switch 623. The switch 622 is electrically coupled between the sustaining voltage line Sus_N and the output terminal of the data writing circuit 620, and is configured to turn on or turn off according to the scan voltage signal VScan_N. The switch 623 is electrically coupled between the data line Data_N and the output terminal of the data writing circuit 620, and is configured turn on or turn off according to the scan voltage signal VScan_N. Turn-on time durations of the switch 622 and switch 623 do not overlap.

In addition, in order to make operation and voltage of the transistors M7 and M8 of the voltage-driven OLED pixel 600 of FIG. 6 the same as those of the transistors M4 and M5 of the voltage-driven OLED pixel 300 of FIG. 3B, the voltage-driven OLED pixel 600 further includes an inverting scan line $\overline{\text{Scan_N}}$ for the scan line Scan_N. The inverting scan line $\overline{\text{Scan_N}}$ is electrically coupled to control terminals of the transistors M7 and M8 to drive the transistors M7 and M8.

In this embodiment, the switch 670 of the voltage-driven OLED pixel includes the transistor M7. The transistor M7 has a first signal terminal electrically coupled to the second terminal 610*b*, a control terminal electrically coupled to the inverting scan line $\overline{\text{Scan_N}}$, and a second signal terminal electrically coupled to the second predetermined voltage VSS. The switch 622 includes the transistor M8. The transistor M8 has a first signal terminal electrically coupled to the sustaining voltage line Sus_N, a control terminal electrically coupled to the inverting scan line $\overline{\text{Scan_N}}$, and a second signal terminal electrically coupled to the output terminal of the data writing circuit 620. The switch 623 includes the transistor M6. The transistor M6 includes a first signal terminal electrically coupled to the data line Data_N, a second signal terminal electrically coupled to the output terminal of the data writing circuit 620, and a control terminal configured to receive the scan voltage signal VScan_N. The transistors M6, M7, M8 are all P-type thin film transistors.

Figure 7:
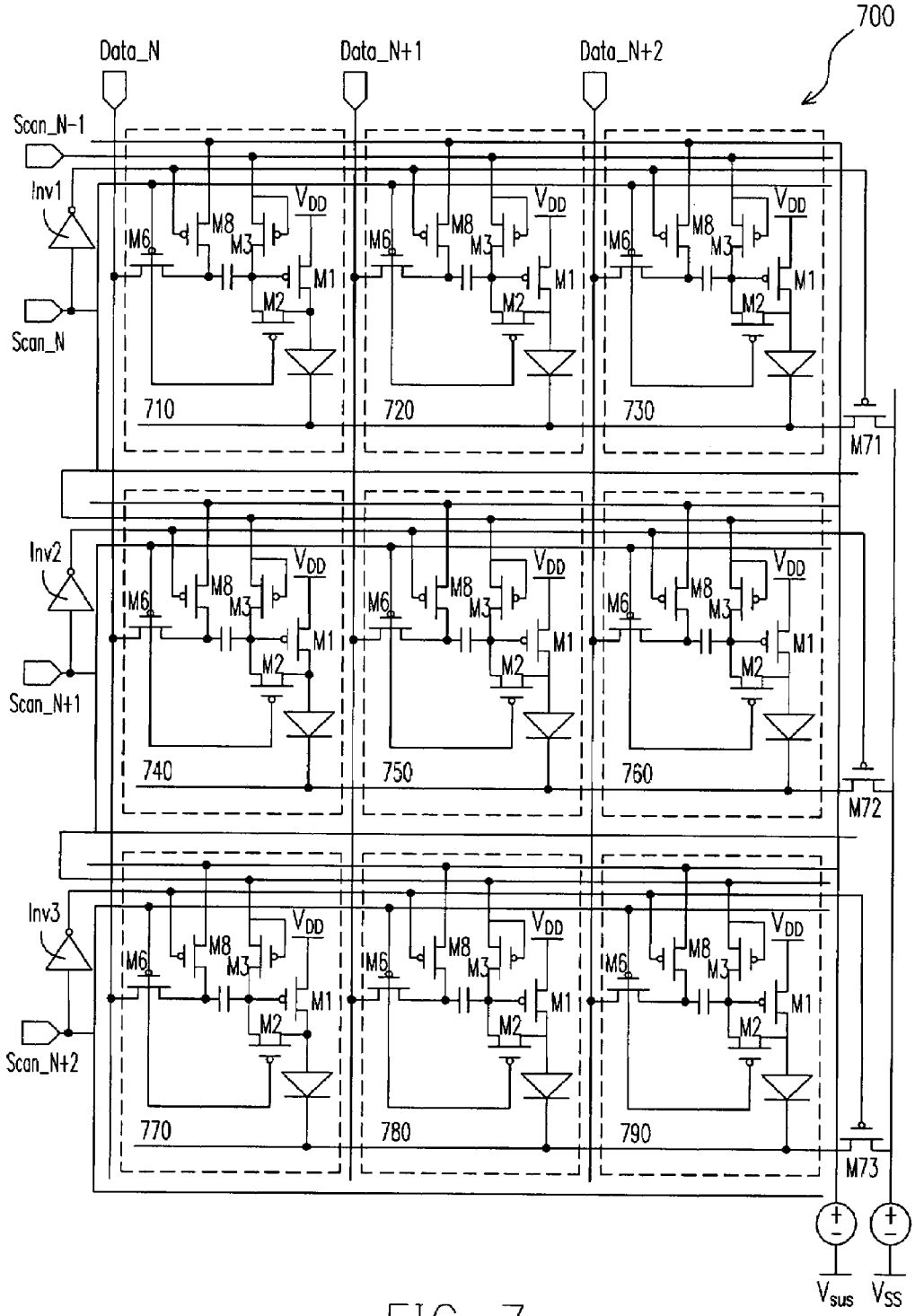
FIG. 7 illustrates a part of the circuit diagram of an organic light-emitting diode display panel formed by the voltage-driven organic light-emitting diode pixels of FIG. 6.

FIG. 7 illustrates a part of the circuit diagram of an organic light-emitting diode display panel 700 (referred to as "OLED panel") formed by the voltage-driven OLED pixels of FIG. 6. Referring to FIG. 7, transistors M1, M2, M3, M6, M8, the first predetermined voltage VDD, and electrical connections and signals of other components of each of the voltage-driven OLED pixels 710-790 of the OLED panel 700 are all similar to those of the voltage-driven OLED pixel 600 of FIG. 6. In addition, the transistors M71-M73 can be arranged outside the voltage-driven OLED pixels 710-790, wherein the voltage-driven OLED pixels 710, 720, 730 of the OLED panel 700 share the transistor M71, the voltage-driven OLED pixels 740, 750, 760 share the transistor M72, the voltage-driven OLED pixels 770, 780, 790 share the transistor M73, and the sustaining voltage Vsus is shared by the voltage-driven OLED pixels 710-790. Further, the second predetermined voltage VSS can be electrically coupled to the second signal terminals of the transistors M71, M72, and M73 and arranged outside the voltage-driven OLED pixels 710-790. All of these arrangements can increase the aperture ratio of the voltage-driven OLED pixels 710~790 of the OLED panel 700.

In addition, the OLED panel 700 employs multiple scan lines Scan_N, Scan_N+1, Scan_N+2 to control turn-on and turn-off states of, for example, the transistors of the voltage-driven OLED pixels 710-790, wherein the sustaining voltage Vsus can also be shared by the OLED pixels 710-790. Also, inverters Inv1, Inv2 and Inv3 are configured to invert respective signals of the scan line Scan_N, Scan_N+1, Scan_N+2, wherein the inverter Inv1 is configured to invert the signal of the scan line Scan_N and input it into the voltage-driven OLED pixels 710, 720, 730, the inverter Inv2 is configured to invert the signal of the scan line Scan_N+1 and input it into the voltage-driven OLED pixels 740, 750, 760, and the inverter Inv3 is configured to invert the signal of the scan line Scan_N+2 and input it into the voltage-driven OLED pixels 770, 780, 790. In addition, the signals of the scan line Scan_N−1 and the scan line Scan_N are inputted into the voltage-driven OLED pixels 710, 720, 730, the signals of the scan line Scan_N and the scan line Scan_N+1 are inputted into the voltage-driven OLED pixels 740, 750, 760, and the signals of the scan line Scan_N+1 and the scan line Scan_N+2 are inputted into the voltage-driven OLED pixels 770, 780, 790. Besides, the data line Data_N supplies data to the voltage-driven OLED pixels 710, 740, 770 on the same column, the data line Data_N+1 supplies data to the voltage-driven OLED pixels 720, 750, 780 on the same column, and the data line Data_N+2 supplies data to the voltage-driven OLED pixels 730, 760, 790 on the same column.

Figure 8:
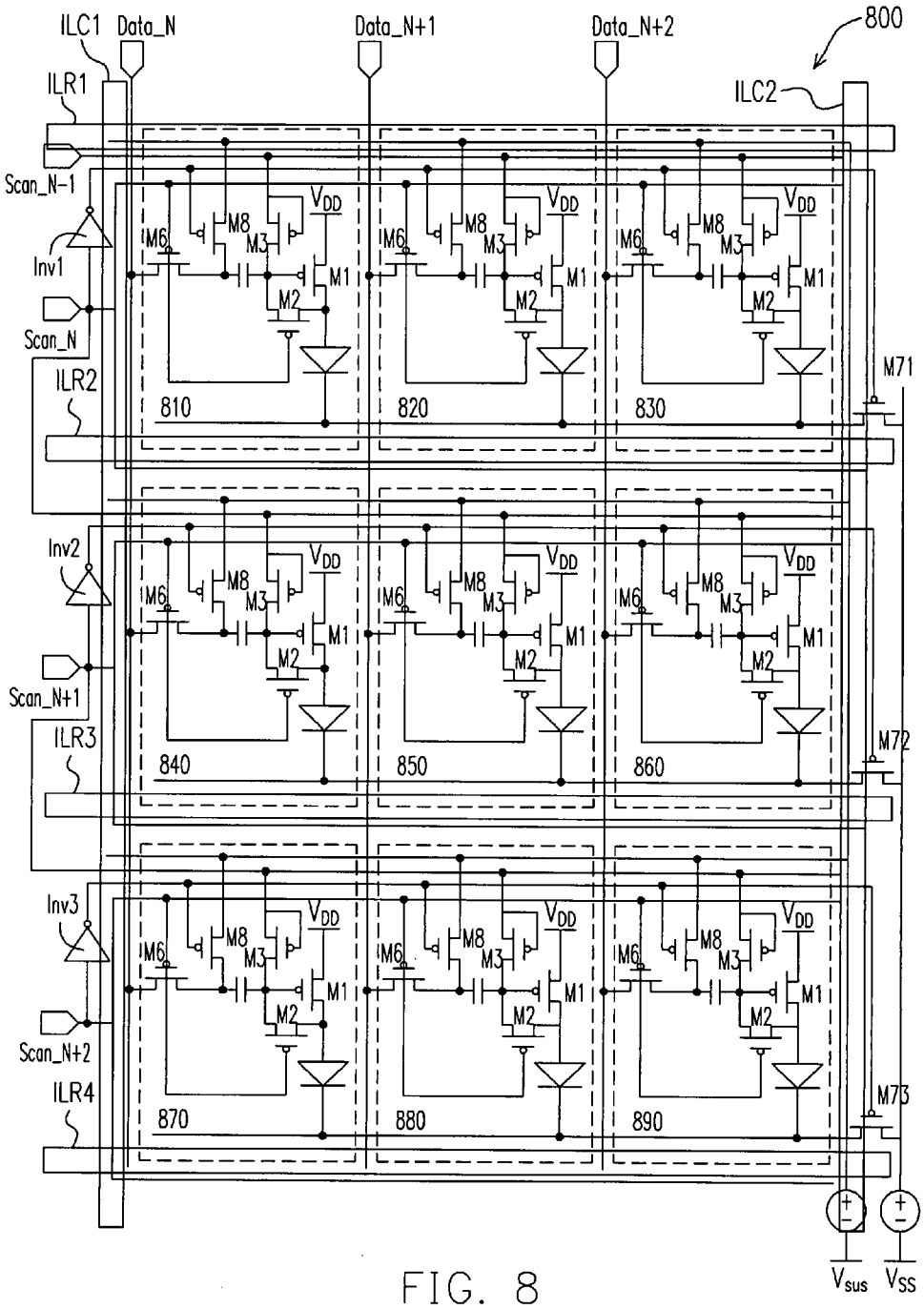
FIG. 8 illustrates a part of the circuit diagram of another organic light-emitting diode display panel in accordance with the circuit diagram of the organic light-emitting diode display panel of FIG. 7.

FIG. 8 illustrates a part of the circuit diagram of another OLED panel 800 in accordance with the circuit diagram of the OLED panel of FIG. 7. Referring to FIG. 8, transistors M1, M2, M3, M6, M8, the first predetermined voltage VDD, and electrical connections and signals of other components of each of the OLED pixels 810-890 of the OLED panel 800 are all similar to those of the voltage-driven OLED pixel 600 of FIG. 6. In addition, the transistors M71-M73 can be arranged outside the voltage-driven OLED pixels 810~890, wherein the voltage-driven OLED pixels 810, 820, 830 of the OLED panel 800 share the transistor M71, the voltage-driven OLED pixels 840, 850, 860 share the transistor M72, the voltage-driven OLED pixels 870, 880, 890 share the transistor M73, and the sustaining voltage Vsus is shared by the voltage-driven OLED pixels 810-890. Besides, the second predetermined voltage VSS can be electrically coupled to the second signal terminals of the transistors M71-M73 and arranged outside the voltage-driven OLED pixels 810-890. All of these arrangements can increase the aperture ratio of the voltage-driven OLED pixels 810-890 of the OLED panel 800.

In addition, the OLED panel 800 employs multiple scan lines Scan_N, Scan_N+1, Scan_N+2 to control turn-on and turn-off states of, for example, the transistors of the voltage-driven OLED pixels 810-890, wherein the sustaining voltage Vsus can also be commonly used by the OLED pixels 810-890. Also, inverters Inv1, Inv2 and Inv3 are configured to respectively invert signals of the scan line Scan_N, Scan_N+1, Scan_N+2, wherein the inverter Inv1 is configured to invert the signal of the scan line Scan_N and input it into the voltage-driven OLED pixels 810, 820, 830, the inverter Inv2 is configured to invert the signal of the scan line Scan_N+1 and input it into the voltage-driven OLED pixels 840, 850, 860, and the inverter Inv3 is configured to invert the signal of the scan line Scan_N+2 and input it into the voltage-driven OLED pixels 870, 880, 890. In addition, the signals of the scan line Scan_N−1 and scan line Scan_N are inputted into the voltage-driven OLED pixels 810, 820, 830, the signals of the scan line Scan_N and scan line Scan_N+1 are inputted into the voltage-driven OLED pixels 840, 850, 860, and the signals of the scan line Scan_N+1 and scan line Scan_N+2 are inputted into the voltage-driven OLED pixels 870, 880, 890. Besides, the data line Data_N supplies data to the voltage-driven OLED pixels 810, 840, 870 on the same column, the data line Data_N+1 supplies data to the voltage-driven OLED pixels 820, 850, 880 on the same column, and the data line Data_N+2 supplies data to the voltage-driven OLED pixels 830, 860, 890 on the same column.

Further, the OLED panel 800 includes insulating layers ILC1, ILC2 and ILR1-ILR4 to isolate cathodes of the voltage-driven OLED pixels, thereby preventing the cathodes of the voltage-driven OLED pixels (for example, the voltage-driven OLED pixels 810-830) on each scan line from electrically connecting directly with the cathodes of the voltage-driven OLED pixels on other scan lines to avoid short circuit between the cathodes of the voltage-driven OLED pixels on different scan lines.

Figure 9:
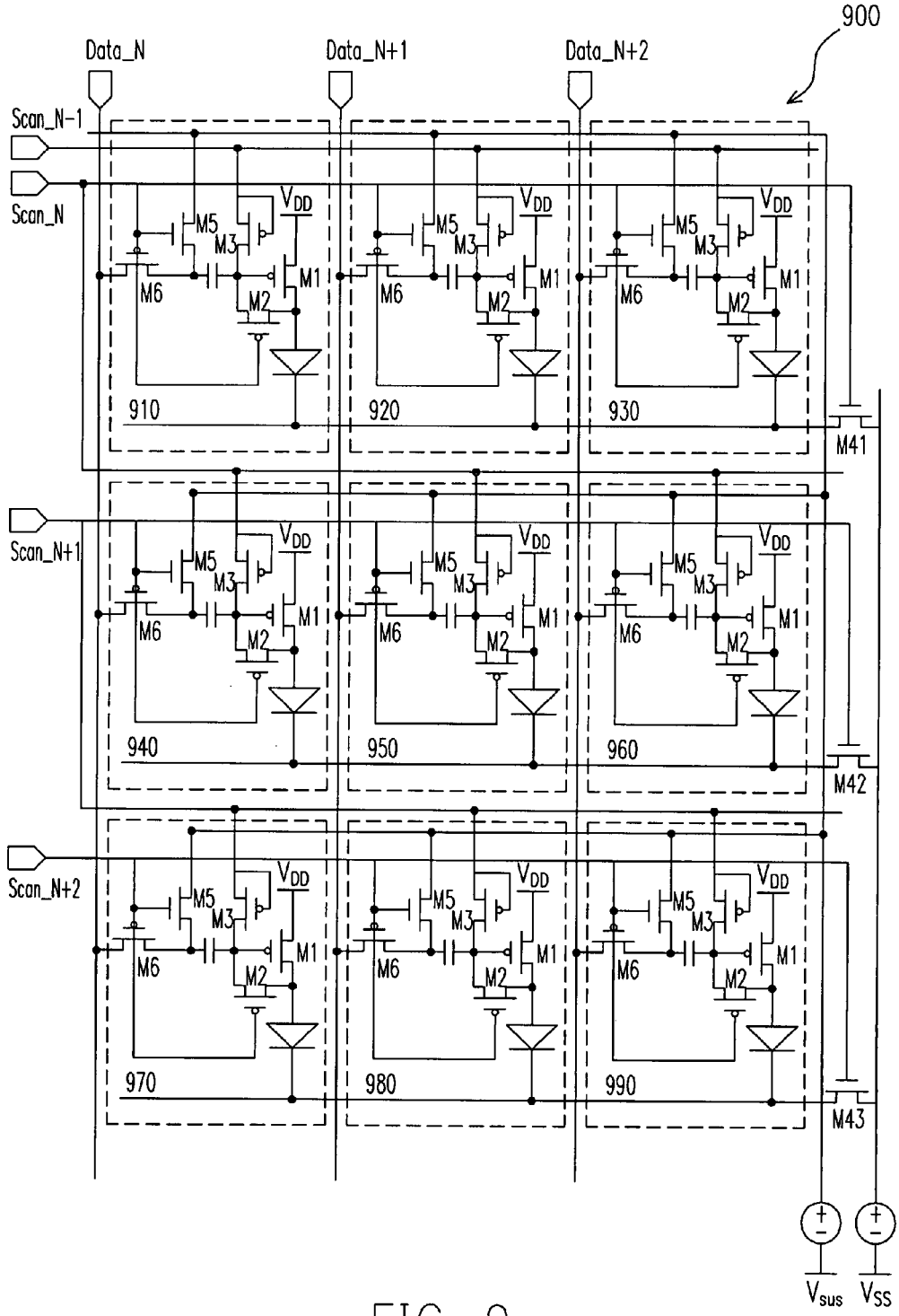
FIG. 9 illustrates a part of the circuit diagram of an organic light-emitting diode display panel formed by the voltage-driven organic light-emitting diode pixels of FIG. 5.

FIG. 9 illustrates a part of the circuit diagram of an OLED panel formed by the OLED pixels of FIG. 5. Referring to FIG. 9, in the OLED panel 900, transistors M1, M2, M3, M6, M8, the first predetermined voltage VDD, and electrical connections and signals of other components of each of the OLED pixels 910-990 are all similar to those of the voltage-driven OLED pixel 500 of FIG. 5. In addition, transistors M41~M43 can be arranged outside the voltage-driven OLED pixels 910-990, wherein the transistor M41 is shared by the voltage-driven OLED pixels 910, 920, 930 of the OLED panel 800, the transistor M42 is shared by the voltage-driven OLED pixels 940, 950, 960, the transistor M43 is shared by the voltage-driven OLED pixels 970, 980, 990, and the sustaining voltage Vsus is shared by the voltage-driven OLED pixels 910-990. In addition, the second predetermined voltage VSS can be electrically coupled to second signal terminals of the transistors M41-M43 and arranged outside the voltage-driven OLED pixels 910-990. All of these arrangements can increase the aperture ratio of the voltage-driven OLED pixels 910-990 of the OLED panel 900.

In addition, the OLED panel 900 employs multiple scan lines Scan_N, Scan_N+1, Scan_N+2 to control turn-on and turn-off states of, for example, the transistors of the voltage-driven OLED pixels 910~990. In addition, the signals of the scan line Scan_N−1 and the scan line Scan_N are inputted into the voltage-driven OLED pixels 910, 920, 930, the signals of the scan line Scan_N and the scan line Scan_N+1 are inputted into the voltage-driven OLED pixels 940, 950, 960, and the signals of the scan line Scan_N+1 and the scan line Scan_N+2 are inputted into the voltage-driven OLED pixels 970, 980, 990. Besides, the data line Data_N supplies data to the voltage-driven OLED pixels 910, 940, 970 on a same column, the data line Data_N+1 supplies data to the voltage-driven OLED pixels 920, 950, 980 on a same column, and the data line Data_N+2 supplies data to the voltage-driven OLED pixels 930, 960, 990 on a same column.

Figure 10:
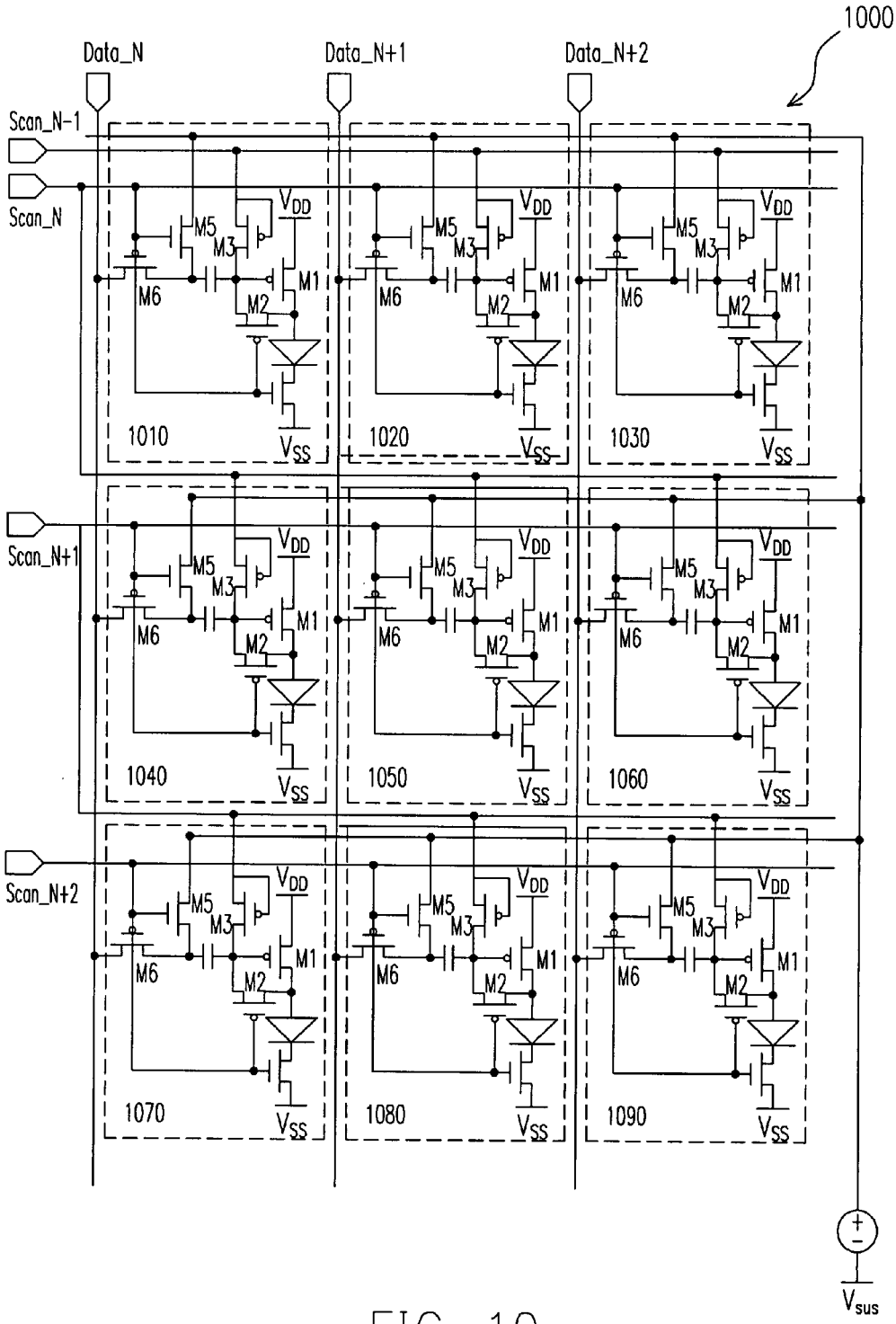
FIG. 10 illustrates a part of the circuit diagram of an organic light-emitting diode display panel formed by the voltage-driven organic light-emitting diode pixels of FIG. 3B.

FIG. 10 illustrates a part of the circuit diagram of an OLED panel 1000 formed by the voltage-driven OLED pixels of FIG. 3B. Referring to FIG. 10, in the OLED panel 1000 of this embodiment, transistors M1-M6, the first predetermined voltage VDD, the second predetermined voltage VSS, and electrical connections and signals of other components of each of the OLED pixels 1010-1090 are all similar to those of the voltage-driven OLED pixel 300 of FIG. 3B. In addition, the sustaining voltage Vsus can also be shared by the OLED pixels 1010-1090. This can increase the aperture rate of the voltage-driven OLED pixels 1010-1090 of the OLED panel 1000.

In addition, the OLED panel 1000 employs multiple scan lines Scan_N, Scan_N+1, Scan_N+2 to control turn-on and turn-off states of, for example, the transistors of the voltage-driven OLED pixels 1010-1090. In addition, the signals of the scan line Scan_N−1 and the scan line Scan_N are inputted into the voltage-driven OLED pixels 1010, 1020, 1030, the signals of the scan line Scan_N and the scan line Scan_N+1 are inputted into the voltage-driven OLED pixels 1040, 1050, 1060, and the signals of the scan line Scan_N+1 and the scan line Scan_N+2 are inputted into the voltage-driven OLED pixels 1070, 1080, 1090. Besides, the data line Data_N supplies data to the voltage-driven OLED pixels 1010, 1040, 1070 on a same column, the data line Data_N+1 supplies data to the voltage-driven OLED pixels 1020, 1050, 1080 on a same column, and the data line Data_N+2 supplies data to the voltage-driven OLED pixels 1030, 1060, 1090 on the same column.

In summary, because the voltage-driven OLED pixels of the present invention can ensure that the voltage of the terminal B in FIGS. 3B, 5 and 6 is in a level below VDD−Vth before each time the data is written, and part of the components can be arranged outside the OLED pixels and shared by multiple OLED pixels of the OLED panel, the variations of the threshold voltage Vth of the driving transistors of the OLED panel can be compensated, thus avoiding luminance non-uniformity of the pixels on the OLED panel. Also because of this, the voltage-driven OLED pixel can have a relatively larger aperture ratio, thus increasing pixel luminance and reducing cost. Moreover, the present invention can also avoid luminance non-uniformity of the image due to the IR drop of the OLED panel.

Although the preferred embodiments of the invention have been described above, it will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A voltage-driven organic light-emitting diode pixel, comprising:

an organic light-emitting diode (OLED), having a first terminal and a second terminal;

a data writing circuit, electrically coupled to a data line, a sustaining voltage line and a first scan line, the data writing circuit having an output terminal and determining whether to establish an electrical communication between the output terminal and the data line or between the output terminal and the sustaining voltage line according to a first scan signal carried on the first scan line;

a capacitor, having a first terminal and a second terminal, the first terminal of the capacitor electrically coupled to the output terminal of the data writing circuit;

a first transistor, having first and second signal terminals and a control terminal, the first signal terminal of the first transistor electrically coupled to a first predetermined voltage, the second signal terminal of the first transistor electrically coupled to the first terminal of the OLED, and the control terminal of the first transistor electrically coupled to the second terminal of the capacitor;

a second transistor, having first and second signal terminals and a control terminal, the first signal terminal of the second transistor electrically coupled to the control terminal of the first transistor, the second signal terminal of the second transistor electrically coupled to the first terminal of the OLED, and the control terminal of the second transistor configured to receive the first scan signal;

a third transistor, having first and second signal terminals and a control terminal, the first signal terminal and the control terminal of the third transistor both electrically coupled to a second scan line, and the second signal terminal of the third transistor electrically coupled to the first signal terminal of the second transistor; and a first switch, having a switch terminal electrically coupled to the second terminal of the OLED, and another switch terminal electrically coupled to a second voltage, the first switch configured to turn on or turn off according to the first scan signal;

wherein the first, second and third transistors are of the same type, and scan sequence of the second scan line is arranged before that of the first scan line.

2. The voltage-driven organic light-emitting diode pixel in accordance with claim 1, wherein the data writing circuit comprises:

a second switch, electrically coupled between the sustaining voltage line and the output terminal of the data writing circuit, the second switch configured to turn on or turn off according to the first scan signal; and a third switch, electrically coupled between the data line and the output terminal of the data writing circuit, the third switch configured to turn on or turn off according to the first scan signal;

wherein turn-on time durations of the second and third switches do not overlap.

3. The voltage-driven organic light-emitting diode pixel in accordance with claim 2, wherein:

the first switch includes a fourth transistor having first and second signal terminals and a control terminal, the first signal terminal of the fourth transistor electrically coupled to the second terminal of the OLED, the control terminal of the fourth transistor configured to receive the first scan signal, and the second signal terminal of the fourth transistor electrically coupled to the second predetermined voltage;

the second switch includes a fifth transistor having first and second signal terminals and a control terminal, the first signal terminal of the fifth transistor electrically coupled to the sustaining voltage line, the control terminal of the fifth transistor configured to receive the first scan signal, and the second signal terminal of the fifth transistor electrically coupled to the output terminal of the data writing circuit;

the third switch includes a sixth transistor having first and second signal terminals and a control terminal, the first signal terminal of the sixth transistor electrically coupled to the data line, the second signal terminal of the sixth transistor electrically coupled to the output terminal of the data writing circuit, and the control terminal of the sixth transistor configured to receive the first scan signal;

wherein the sixth transistor and the first transistor are of a same conductive type, and the conductive type of the fourth and fifth transistors is different from that of the first transistor.

4. The voltage-driven organic light-emitting diode pixel in accordance with claim 1, wherein the data writing circuit comprises:

a second switch electrically coupled between the sustaining voltage line and the output terminal of the data writing circuit, the second switch configured to receive an inverting signal having a phase opposite to the first scan signal to determine turn-on or turn-off of the second switch; and a third switch electrically coupled between the data line and the output terminal of the data writing circuit, the third switch configured to turn on or turn off according to the first scan signal;

wherein turn-on time durations of the second and third switches do not overlap.

5. The voltage-driven organic light-emitting diode pixel in accordance with claim 4, wherein:

the first switch includes a fourth transistor, the fourth transistor having first and second signal terminals and a control terminal, the first signal terminal of the fourth transistor electrically coupled to the second terminal of the OLED, the control terminal of the fourth transistor configured to receive the inverting signal, and the second signal terminal of the fourth transistor electrically coupled to the second predetermined voltage;

the second switch includes a fifth transistor, the fifth transistor having first and second signal terminals and a control terminal, the first signal terminal of the fifth transistor electrically coupled to the sustaining voltage line, the control terminal of the fifth transistor configured to receive the inverting signal, and the second signal terminal of the fifth transistor electrically coupled to the output terminal of the data writing circuit; and the third switch includes a sixth transistor, the sixth transistor having first and second signal terminals and a control terminal, the first signal terminal of the sixth transistor electrically coupled to the data line, the second signal terminal of the sixth transistor electrically coupled to the output terminal of the data writing circuit; and the control terminal of the sixth transistor configured to receive the first scan signal;

wherein the fourth, fifth and sixth transistors and the first transistor are transistors of a same conductive type.

6. An organic light-emitting diode display panel, which employs multiple scan lines to control turn-on or turn-off of multiple organic light-emitting diode pixels, wherein each of the multiple organic light-emitting diode pixels comprises:

an organic light-emitting diode (OLED), having a first terminal and a second terminal;

a data writing circuit, having a plurality of input terminals and an output terminal, the input terminals electrically coupled to a data line, a sustaining voltage line and a first scan line, the data writing circuit determining whether to establish an electrical connection between the output terminal and the data line or between the output terminal and the sustaining voltage line according to a first scan signal carried on the first scan line;

a capacitor, having a first terminal and a second terminal, the first terminal of the capacitor electrically coupled to the output terminal of the data writing circuit;

a first transistor, having first and second signal terminals and a control terminal, the first signal terminal of the first transistor electrically coupled to a first predetermined voltage, the second signal terminal of the first transistor electrically coupled to the first terminal of the OLED, and the control terminal of the first transistor electrically coupled to the second terminal of the capacitor;

a second transistor, having first and second signal terminals and a control terminal, the first signal terminal of the second transistor electrically coupled to the control terminal of the first transistor, the second signal terminal of the second transistor electrically coupled to the first terminal of the OLED, and the control terminal of the second transistor configured to receive the first scan signal;

a third transistor, having first and second signal terminals and a control terminal, the first signal terminal and the control terminal of the third transistor both electrically coupled to a second scan line, and the second signal terminal of the third transistor electrically coupled to the first signal terminal of the second transistor; and a first switch, having a first terminal and a second terminal, the second terminal of the first switch electrically coupled to a second predetermined voltage, the first switch configured to turn on or turn off according to the first scan signal;

wherein the first, second and third transistors are transistors of a same type, and scan sequence of the second scan line is arranged before that of the first scan line;

wherein, among the organic light-emitting diode pixels that determine whether to establish the electrical connection between the output terminal and the scan line or between the output terminal and the sustaining voltage line according to the first scan signal, at least two of the organic light-emitting diode pixels have the second terminals electrically couple to the first terminal of the first switch.

7. The organic light-emitting diode display panel in accordance with claim 6, wherein the data writing circuit comprises:

a second switch, electrically coupled between the sustaining voltage line and the output terminal of the data writing circuit, the second switch configured to turn on or turn off according to the first scan signal; and a third switch, electrically coupled between the data line and the output terminal of the data writing circuit, the third switch configured to turn on or turn off according to the first scan signal;

wherein turn-on time durations of the second and third switches do not overlap.

8. The organic light-emitting diode display panel in accordance with claim 7, wherein:

the first switch includes a fourth transistor, the fourth transistor having first and second signal terminals and a control terminal, the first signal terminal of the fourth transistor electrically coupled to the second terminal of the OLED, the control terminal of the fourth transistor configured to receive the first scan signal, and the second signal terminal of the fourth transistor electrically coupled to the second predetermined voltage;

the second switch includes a fifth transistor, the fifth transistor having first and second signal terminals and a control terminal, the first signal terminal of the fifth transistor electrically coupled to the sustaining voltage line, the control terminal of the fifth transistor configured to receive the first scan signal, and the second signal terminal of the fifth transistor electrically coupled to the output terminal of the data writing circuit; and the third switch includes a sixth transistor, the sixth transistor having first and second signal terminals and a control terminal, the first signal terminal of the sixth transistor electrically coupled to the data line, the second signal terminal of the sixth transistor electrically coupled to the output terminal of the data writing circuit, and the control terminal of the sixth transistor configured to receive the first scan signal;

wherein the sixth transistor and the first transistor are of the same conductive type, and the conductive type of the fourth and fifth transistors is different from that of the first transistor.

9. The organic light-emitting diode display panel in accordance with claim 6, wherein the data writing circuit comprises:

a second switch, electrically coupled between the sustaining voltage line and the output terminal of the data writing circuit, the second switch configured to turn on or turn off according to an inverting signal having a phase opposite to the first scan signal; and a third switch, electrically coupled between the data line and the output terminal of the data writing circuit, the third switch configured to turn on or turn off according to the first scan signal;

wherein turn-on time durations of the second and third switches do not overlap.

10. The organic light-emitting diode display panel in accordance with claim 9, wherein:

the first switch includes a fourth transistor, the fourth transistor having first and second signal terminals and a control terminal, the first signal terminal of the fourth transistor electrically coupled to the second terminal of the OLED, the control terminal of the fourth transistor configured to receive the inverting signal, and the second signal terminal of the fourth transistor electrically coupled to the second predetermined voltage;

the second switch includes a fifth transistor, the fifth transistor having first and second signal terminals and a control terminal, the first signal terminal of the fifth transistor electrically coupled to the sustaining voltage line, the control terminal of the fifth transistor configured to receive the inverting signal, and the second signal terminal of the fifth transistor electrically coupled to the output terminal of the data writing circuit; and the third switch includes a sixth transistor, the sixth transistor having first and second signal terminals and a control terminal, the first signal terminal of the sixth transistor electrically coupled to the data line, the second signal terminal of the sixth transistor electrically coupled to the output terminal of the data writing circuit; and the control terminal of the sixth transistor configured to receive the first scan signal;

wherein the fourth, fifth and sixth transistors and the first transistor are of the same conductive type.

* * * * *